United States Patent [19]

Ellingson et al.

[11] 4,450,450

[45] May 22, 1984

[54] ANTENNA TOWER ASSEMBLY

[75] Inventors: Gary L. Ellingson, Thief River Falls, Minn.; Wendell E. Miller, Warsaw, Ind.

[73] Assignee: Polar Research, Inc., Thief River Falls, Minn.

[21] Appl. No.: 477,983

[22] Filed: Mar. 23, 1983

Related U.S. Application Data

[62] Division of Ser. No. 272,313, Jun. 10, 1981.

[51] Int. Cl.[3] ..... H01Q 3/02

[52] U.S. Cl. ..... 343/758; 343/882; 343/766

[58] Field of Search ..... 211/163; 52/65, 110; 74/504; 343/757, 758, 763, 766, 878, 879, 880, 882

[56] References Cited

U.S. PATENT DOCUMENTS

| | | | |
|---|---|---|---|
| 2,290,692 | 7/1942 | Lindenblad | 343/879 |
| 2,605,417 | 7/1952 | Andrews | 211/163 |
| 2,623,999 | 12/1952 | Kulikowski | 343/758 |
| 2,642,754 | 6/1953 | De Conti | 74/504 |
| 2,654,031 | 9/1953 | Mullins et al. | 343/5 R |
| 3,146,452 | 8/1964 | Rose | 343/758 |
| 3,187,333 | 6/1965 | Ciotek et al. | 343/766 |
| 3,246,431 | 4/1966 | Faerber | 52/65 |
| 3,541,570 | 11/1970 | Onnigian | 343/704 |
| 3,546,699 | 12/1970 | Smith | 343/100 |
| 3,790,950 | 2/1974 | Smith et al. | 343/879 |
| 4,293,861 | 10/1981 | Winegard et al. | 343/766 |

FOREIGN PATENT DOCUMENTS

| | | | |
|---|---|---|---|
| 1466609 | 2/1969 | Fed. Rep. of Germany | 343/763 |
| 808961 | 2/1959 | United Kingdom | 343/DIG. 1 |

*Primary Examiner*—Eli Lieberman

*Attorney, Agent, or Firm*—Wendell E. Miller

[57] ABSTRACT

The present invention provides an apparatus for mounting and both separate and selective rotational positioning of a plurality of separate antennas, or search devices, on a single tower of the type having a plurality of vertically-disposed tower legs (20*a*–20*c*) and having bracing (22) between adjacent pairs of the tower legs. The preferred embodiments include an antenna-mounting ring, or search-device mounting ring (142 or 406) that is attached to the tower (12) by a plurality of shaft-mounted support rollers (160, 219, or 306).

14 Claims, 18 Drawing Figures

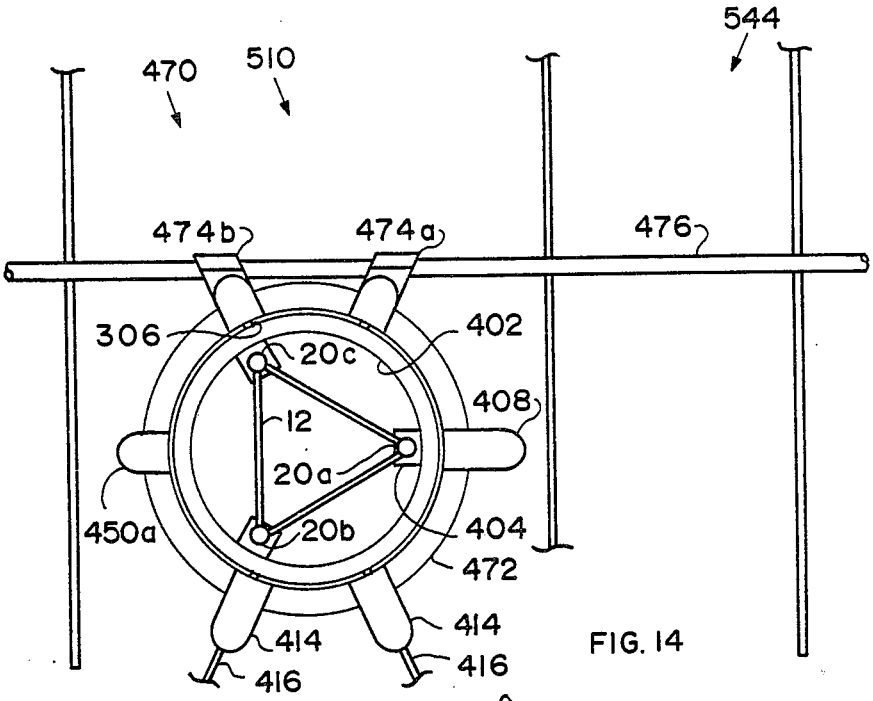
FIG. 14
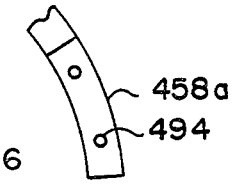
FIG. 16
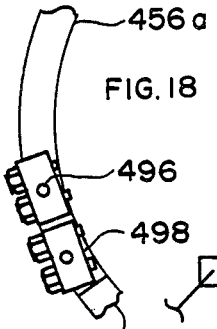
FIG. 18
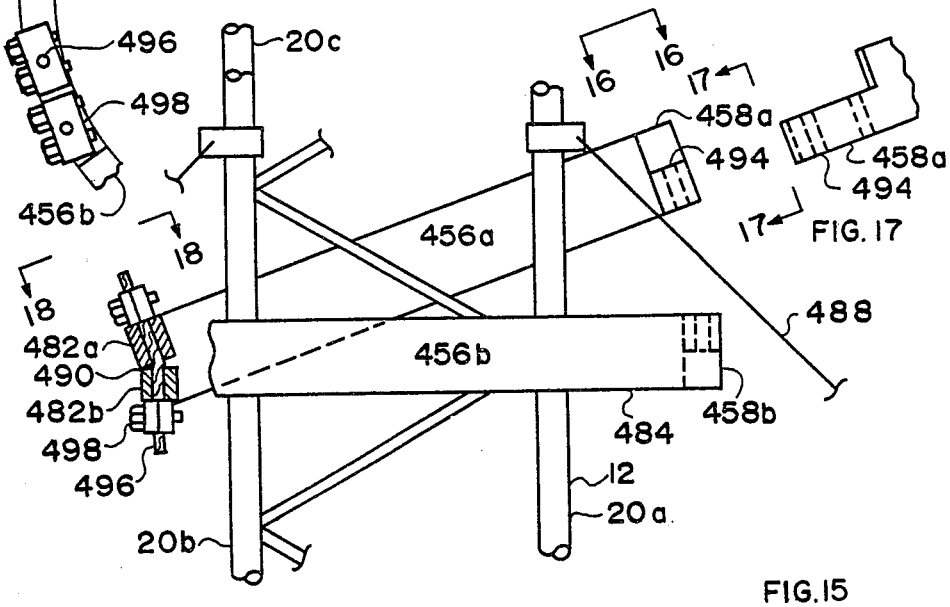
FIG. 17
FIG. 15

ANTENNA TOWER ASSEMBLY

This is a division of application Ser. No. 06/272,313, filed June 10, 1981.

The present invention relates generally to antenna tower assemblies, and more particularly to apparatus for mounting and rotating a plurality of vertically-spaced antennas on a single antenna tower.

BACKGROUND ART

It is common practice to mount a plurality of separate antennas, which may include both receiving and transmitting antennas, on a single antenna tower. Further, it is traditional practice to mount one of the antennas on the top of the antenna tower and to rotate the one antenna by means of an electric motor and gear reducer. The remainder of the antennas are then mounted to the face of the antenna tower at various heights thereto. Thus only one antenna, that is, the antenna which is mounted to the top of the tower, is rotatable, and the remainder of the antennas are fixedly secured to the antenna tower.

Alternately, several antennas are mounted to one antenna rotator on the top of the antenna tower. This method of mounting has the disadvantage that all antennas must be rotated together, thus greatly diminishing the usefulness of the various antennas. Also, this method of mounting is limited in the type and number of antennas that can be rotated because of structural limitations.

When it has been desirable, or necessary, to rotate one of the face-mounted antennas, it has been customary to attach this antenna to the antenna tower by means of an outrigger, or side arm, that extends longitudinally out from the antenna tower. When the antenna tower consists of three vertically-disposed tower legs and truss bracing, it has been customary to construct this side arm from a section of the tower material.

This face-mounted antenna is then mounted at the outer end of the side arm by means of a second electric motor and gear reducer. This type of mounting for a rotatable antenna is highly unsatisfactory because of the effect of the metal in the antenna tower. That is, when this face-mounted and rotatable antenna is directed so that the antenna tower is directly behind the antenna, the antenna may be tuned for high performance. However, as the antenna is rotated to an angle where the antenna tower is to one side or the other of the antenna, the tuning of the antenna will be adversely affected. Further, as the antenna is rotated farther, not only will the tuning of the antenna further deteriorate, but also, the direction-sensing ability of the antenna will be adversely affected. That is, if this rotatable antenna is used as a search antenna, false directional readings will be indicated. Then, as the antenna is rotated to face the antenna tower, its tuning will be degraded even more, making the antenna highly ineffective either for transmission or receiving of radio frequencies.

Alternately, face-mounted antennas have been rotated by rotating the entire antenna tower. Of course, this requires an extremely large, heavy, and costly mechanism, is practical only for relatively short antenna towers of the non-guy-wired type, and has the additional disadvantage that all antennas are rotated simultaneously.

Kulikowski, in U.S. Pat. No. 3,623,999, shows an antenna that is mounted to a sleeve which is disposed coaxially around an antenna tower of the tubular mast type, and that is rotated by an electric drive motor. Kulikowski teaches a method of conductance coupling of the antenna to the lead-in conductors; but he does not address the technical problems of providing a workable rotating mount for face-mounting antennas to an antenna tower.

In particular, Kulikowski does not show, disclose, claim, or even intimate the need for, nor solutions for: vertically supporting the antenna, radially guiding the antenna, guiding against sideward tipping of the antenna-mounting ring, counterbalancing of torsional wind loads, use with towers of the trussed tower-leg type rather than the tubular mast type, electrical heating to overcome icing problems, or means for partially assembling the rotating device at ground level and then moving up past guy wires, all of which are advancements of the present invention.

DISCLOSURE OF INVENTION

In accordance with the broader aspects of this invention, there is provided an antenna tower assembly for the mounting and separately rotating of a plurality of vertically-disposed antennas on a single antenna tower.

In a first preferred configuration, a two-piece antenna-mounting ring is mounted coaxially around an antenna tower of the type having three vertically-disposed tower legs. This antenna-mounting ring includes a V-shaped groove that is circumferentially disposed in an inner circumferential surface of the antenna-mounting ring.

Three support rollers, having vertically-disposed roller shafts, cooperate with upper and lower surfaces of the V-shaped groove in the antenna-mounting ring to rotatably support the antenna-mounting ring. Two of these support rollers are mounted to respective ones of two of the vertically-disposed tower legs by means of a support-roller assembly. A third one of the support rollers is mounted to the third of the tower legs by means of a support and drive assembly that includes an electric motor and gear reduction unit.

Preferably, the antenna-mounting ring includes a plurality of circumferentially-spaced gear teeth; and the roller shaft of the third support roller includes a drive pinion which meshes with the circumferentially-spaced teeth in the antenna-mounting ring and which is driven by the gear reduction unit.

In a second preferred embodiment, a tower-attaching ring circumscribes the three tower legs and is securely attached thereto. An antenna-mounting ring is coaxial to and circumscribes the tower-attaching ring. The antenna-mounting ring is rotatably mounted to, and supported by, the tower-attaching ring by means of a plurality of support rollers which are rotatably mounted to the antenna-mounting ring and which engage a groove that is circumferentially disposed in the outer surface of the tower-attaching ring. The support rollers are mounted for rotation about horizontal axes that are radially disposed with respect to a vertical axis of the antenna tower.

An electric drive motor and gear reduction unit are mounted to, and rotate with, the antenna-mounting ring. This electric drive motor and gear reduction unit rotate a drive pinion which is mounted for rotation about an axis that is both horizontal and radially disposed with respect to a vertical tower axis. The tower-attaching ring includes a plurality of circumferentially-spaced teeth which mesh with the teeth of the drive pinion.

BRIEF DESCRIPTION OF THE DRAWINGS

FIG. 14 is a partial top view of an antenna tower assembly similar to that of FIG. 11, but illustrating a modification thereof for use with large Yagi antennas;

FIG. 15 is a partial side elevation showing the method of moving tower-attaching rings and antenna-mounting rings above guy wires;

FIG. 16 is a partial top view, taken substantially as shown by view line 16—16 of FIG. 15;

FIG. 17 is a partial side view, taken substantially as shown by view line 17—17 of FIG. 15; and FIG. 18 is a partial top view, taken substantially as shown by view line 18—18 of FIG. 15.

BEST MODE FOR CARRYING OUT THE INVENTION

Figure 1:
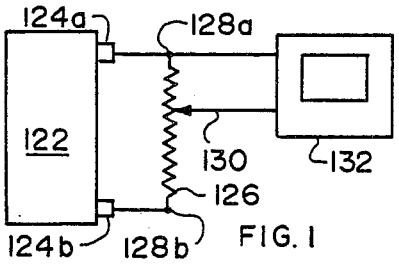
FIG. 1 PRIOR ART
FIG. 1 is a schematic drawing of a direction-indicating device for the embodiments of the succeeding figures.

Referring now to FIG. 1, each of the antenna tower assemblies that will be subsequently described includes a position indicator 120. The position indicator 120 includes a regulated power supply 122 having output terminals **124*a* and 124*b*, a potentiometer 126 having legs 128*a* and 128*b* that are connected respectively to the output terminals 124*a* and 124*b* and having an arm 130, and an electrical meter 132 that is connected to the leg 128*a* and to the arm 130 of the potentiometer 126. The potentiometer 126** schematically represents a ten-turn potentiometer, such as is common in the electronics industry.

The use of a ten-turn potentiometer, and an electrical circuit, such as is shown in FIG. 1, to indicate the rotational position of an antenna, is common to the art.

Figure 2:
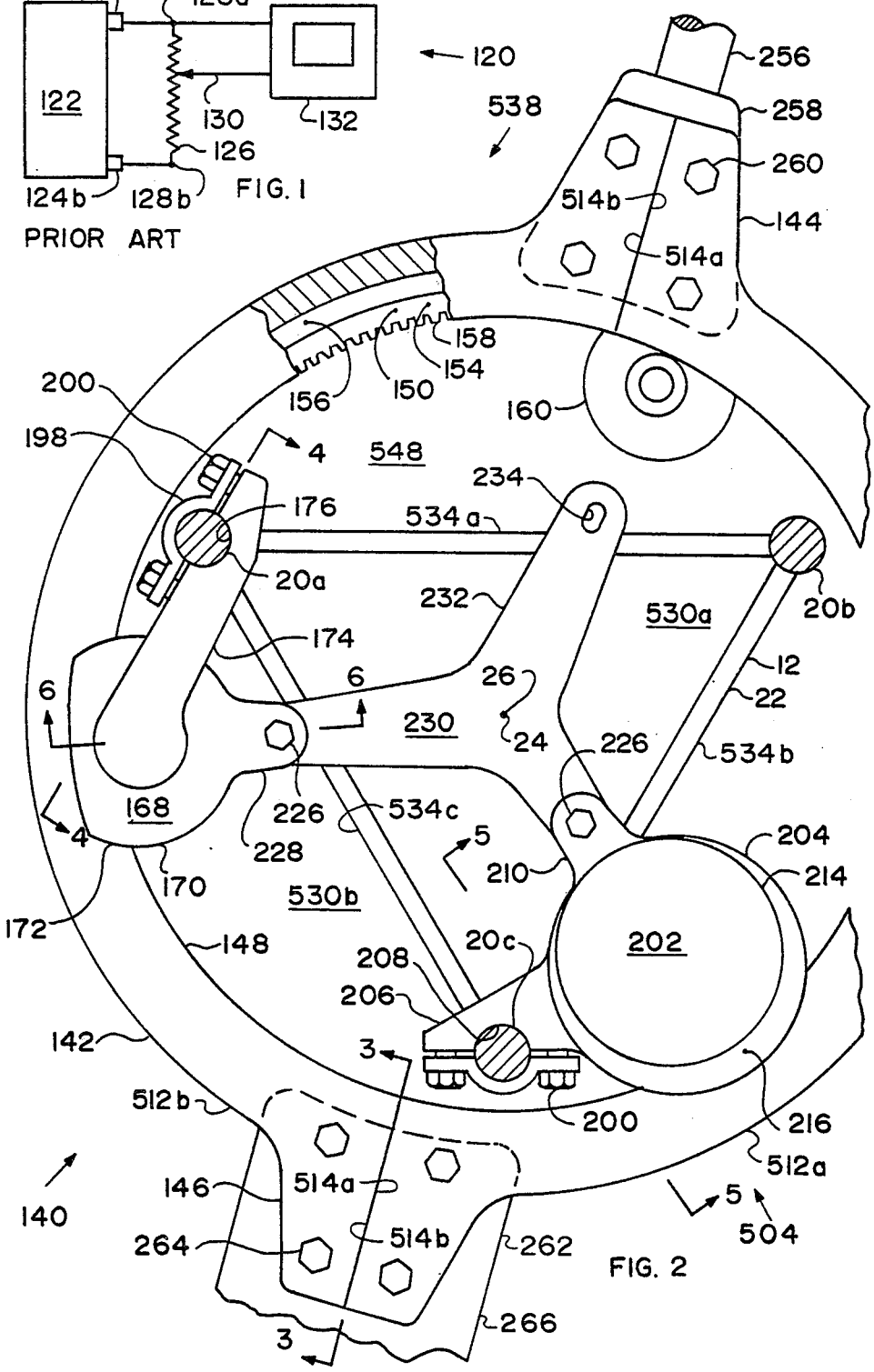
FIG. 2 is a top plan view of a preferred embodiment in which the roller shafts for the support rollers are vertically disposed.
Figure 6:
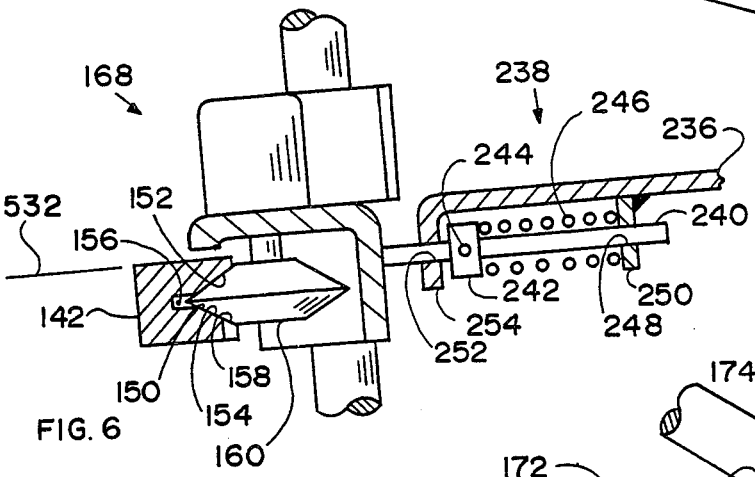
FIG. 6 is a cross-sectional view, taken substantially as shown by section line 6—6 of FIG. 2, showing a modification of the support roller assembly wherein the support roller is resiliently urged into contact with the antenna-mounting ring by a spring.

Referring now to FIGS. 2 and 6, an antenna tower assembly 140 comprises an antenna tower 12 having vertically-disposed tower legs, **20*a*–20*c*, and truss bracing 22. The antenna tower assembly 140 further comprises an antenna-mounting ring 142 having an antenna-attaching lug 144, a counterbalance and wind vane attaching lug 146, a circumferential inner surface or circumferential ring surface 148, a V-shaped circumferential groove 150 that includes an upper groove surface or upper circumferential surface 152 and a lower groove surface or lower circumferential surface 154, a relief groove 156, and a plurality of circumferentially-spaced gear teeth 158**.

Figure 4:
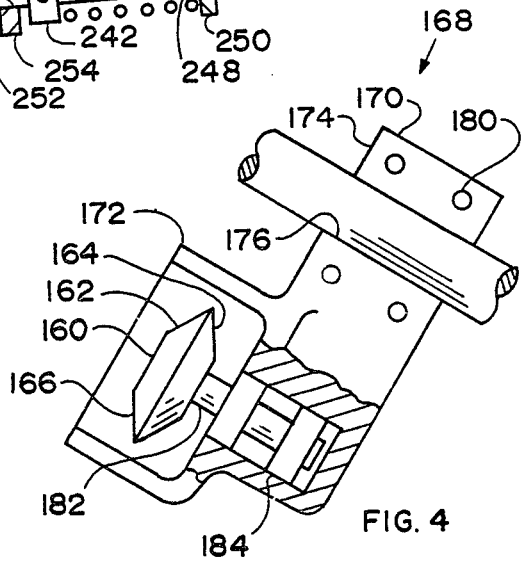
FIG. 4 is a partial side elevation, taken substantially as shown by view line 4—4 of FIG. 2, showing a support roller assembly.

The antenna-mounting ring 142 is supportingly, guidingly, and rotatably attached to the antenna tower 12 by three support rollers such as a support roller 160 of FIGS. 2, 4, and 6.

Referring now to FIG. 4, the support roller 160 includes a wedge-shaped circumferential surface 162 having an upper circumferential support surface 164 that supportingly engages the upper groove surface 152, and having a lower circumferential guide surface 166 that cooperates with the lower groove surface 154 to prevent tilting of the antenna-mounting ring 142.

Referring now to FIGS. 2 and 4, a support roller assembly 168 includes a support housing 170 having a bell-shaped shield 172, a mounting arm 174 having a cylindrical recess 176 therein, and threaded holes 180. The support roller 160 includes a roller shaft 182 which is secured in the housing 170 by longitudinally-spaced ball bearings 184.

Figure 7:
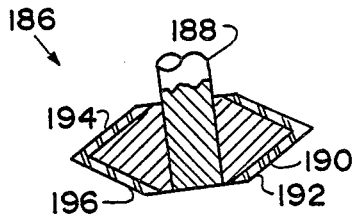
FIG. 7 is an enlarged and partial view of a support roller, taken substantially as shown in FIG. 6, showing a resilient drive surface which may be used in place of the drive pinion of FIG. 5.

Referring now to FIG. 7, in an optional configuration, a support roller 186 includes roller shaft 188. The support roller 186 also includes a roller body 190 which is preferably fabricated from steel, and a resilient cover 192 of molded rubber. Thus, the support roller 186 includes a resilient upper or support surface 194 and a resilient lower or guide surface 196.

Referring again to FIGS. 2 and 4, one of the support roller assemblies 168 is attached to the tower leg **20*a* by a bracket 198 and by bolts 200 that threadably engage the threaded holes 180. A support roller assembly, not shown, which is identical to the support roller assembly 168, is attached to the tower leg 20*b*, the support roller 160** thereof being illustrated.

Figure 5:
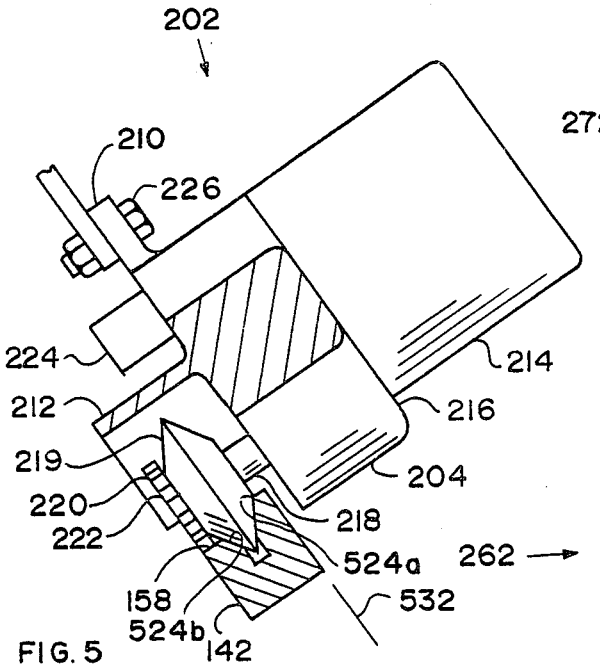
FIG. 5 is a cross-sectional view, taken substantially as shown by section line 5—5 of FIG. 2, showing the support and drive assembly.

Referring now to FIGS. 2 and 5, a support and drive assembly 202 includes a support housing 204 having a mounting arm 206 with a cylindrical recess 208 therein, having an adjusting lug 210, and having a shield portion 212.

The support and drive assembly 202 includes an electric drive motor and gear reducer unit 214 that is attached to a surface 216 of the housing 204 and that is attached to a roller shaft 218. The roller shaft 218 projects through the housing 204.

The support and drive assembly 202 also includes a support roller 219 which is identical to the support roller 160 of FIG. 6 except that the support roller 219 includes the roller shaft 218; and so the support roller 219 includes all of the surfaces as previously described for the support roller 160.

The support and drive assembly 202 also includes a toothed drive pinion 220 that is coaxially attached to the roller shaft 218 and that includes gear teeth 222 which progressively mesh with the gear teeth 158 of the antenna-mounting ring 142.

Finally, the support and drive assembly includes a ten-turn potentiometer 224 that is driven by the electric motor and gear reducer unit 214. The potentiometer 224 and the connection thereof to the electric drive motor and gear reducer unit 214 are conventional and do not comprise an inventive part of the present invention.

Referring now to FIG. 2, the support roller assembly 168 may be rotationally positioned about the tower leg 20*a* by loosening the bolts 200 and a bolt 226 that attaches an adjusting lug 228 of the housing 170 to a spider plate 230. The spider plate 230 includes three legs 232, each of which includes an elongated adjusting hole 234. In like manner, the support and drive assembly 202 may be rotationally positioned about the tower leg 20*c* by loosening the bolts 200 and the bolt 226.

Referring again to FIGS. 2 and 4–6, when any one of the support rollers 160 or 219 is rotationally positioned about the respective one of the tower legs, 20*a*–20*c*, providing close proximity between all the guide surfaces 166 of the support rollers 160 or 219 and the lower groove surface 154 of the antenna-mounting ring 142, the gear teeth 222 of the drive pinion 220 engage the gear teeth 158 of the antenna-mounting ring 142 with proper backlash.

Referring now to FIGS. 2, 6, and 7, alternately, the spider plate 230 may be modified to provide one leg 236 that includes a spring tension device 238. The spring tension device 238 includes a cylindrical rod 240, a collar 242 which is attached to the rod 240 by a transverse pin 244, and a spring 246. The rod 240 is inserted through a hole 248 in a lug 250 and through a hole 252 in a lug 254, the lug 250 being welded to the leg 236 as shown and the lug 254 being integral with the leg 236. In this modification, the bolts 200 are left slightly loose or shims, not shown, are placed between the bracket 198 and the arm 174 so that the bolts 200 can be tightened without the cylindrical recess 176 being tightened against the tower leg 20*a*.

Therefore, rather than the spider plate 230 being attached to the housing 170 by the lug 228, the rod 240 presses against the housing 170 and resiliently urges the housing 170 to rotate outwardly about the antenna tower leg 20*a*, thereby resiliently urging the support roller 160 thereof into resilient engagement with both the upper groove surface 152 and the lower groove surface 154 of the V-shaped groove 150.

In this adaptation, preferably, the toothed drive pinion 220 and the circumferentially-spaced gear teeth 158 are deleted and the support roller 186, with the resilient surfaces 194 and 196, is used to drive the antenna-mounting ring 142 by friction engagement of the resilient surfaces 194 and 196 with respective ones of the groove surfaces 152 and 154.

Figure 3:
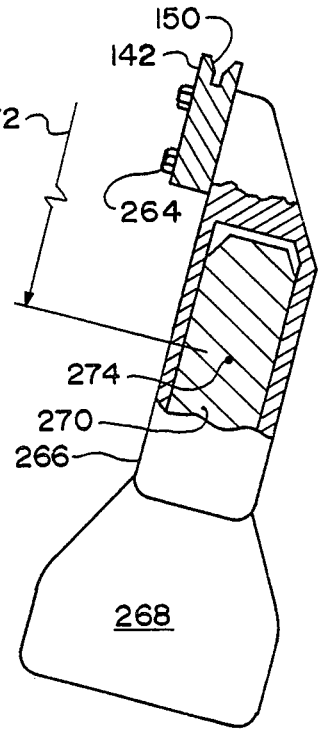
FIG. 3 is a cross-sectional view, taken substantially as shown by section line 3—3 of FIG. 2, showing in reduced scale, the counterweight and wind-vane assembly.

Referring now to FIGS. 2 and 3, an antenna 256 that includes an attaching lug 258 is attached to the lug 144 of the antenna-mounting ring 142 by bolts 260. In like manner, a counterbalance and wind vane assembly 262 is attached to the lug 146 by bolts 264. The counterbalance and wind vane assembly 262 includes a housing 266, a wind vane or wind-resisting member 268, and a counterbalance weight 270 that is retainably inserted into the housing 266.

The wind-resisting member 268 is sized and proportioned to provide a wind-resisting force and torque balance to match and counteract the wind-resisting force and torque applied to the antenna tower 12 by the antenna 256 in the same manner as described in conjunction with FIG. 1; and the counter-balance weight 270 is sized to effectively counterbalance torque that is applied to the antenna-mounting ring 142 by the antenna 256. That is, the product of the weight of the counterbalance weight 270 times a distance 272 from a neut- ral axis 26 of antenna tower 12 to a centroid 274 of the weight 270 is adjusted to substantially equal the weight of the antenna 256 times the distance (not shown) from the neutral axis 26 of the antenna tower 12 to the centroid (not shown) of the weight of the antenna 256.

Figure 8:
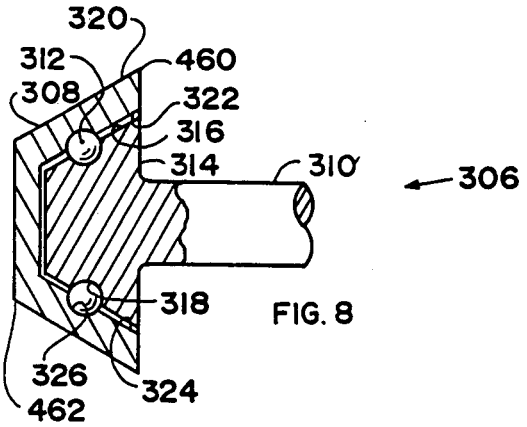
FIG. 8 is an enlarged and cross-sectional view of the support roller and bearing assembly for the embodiment of FIGS. 9–12.
Figure 10:
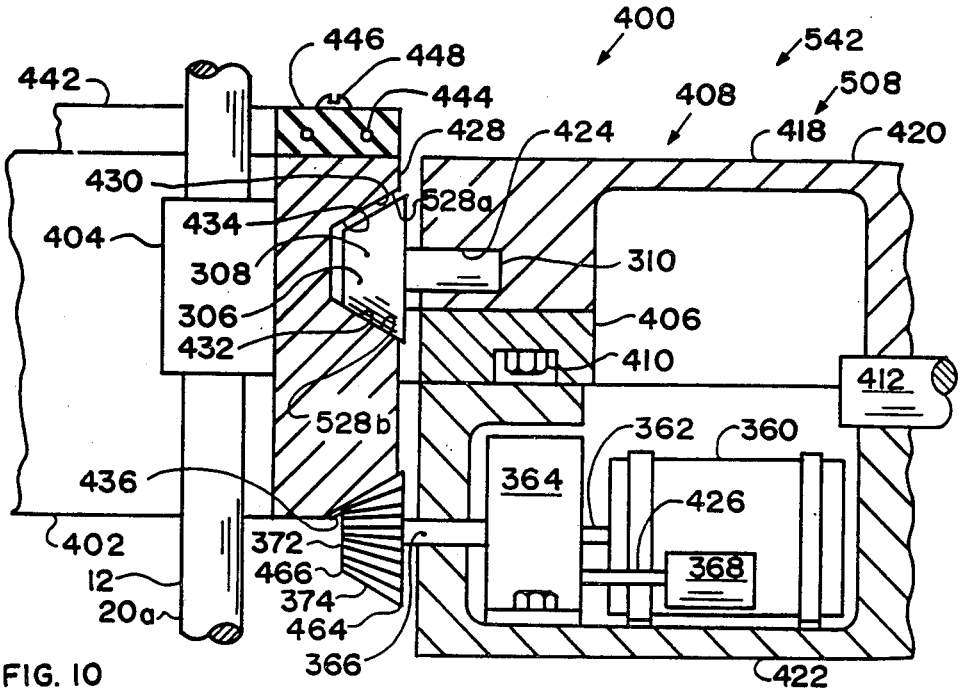
FIG. 10 is a cross-sectional view, taken substantially as shown by section line 10—10 of FIG. 11, showing the support and drive assembly for the embodiment of FIGS. 9–12 that utilizes two circumferentially-disposed rings.

Referring now to FIGS. 8 and 10, and more particularly to FIG. 8, a roller and bearing assembly 306 includes a support roller 308, a roller shaft 310, and a plurality of circumferentially-disposed steel balls 312. The roller shaft 310 includes an enlarged portion 314 having a frustoconical surface 316 and a circumferential ball groove 318 that is disposed in the surface 316. The support roller 308 includes a frustoconical outer surface 320, a bore 322 having a frustoconical inner surface 324, and a circumferentially-disposed ball groove 326 in the inner surface 324. The balls 312 are circumferentially disposed in the grooves 318 and 326, thereby providing an integral ball bearing between the support roller 308 and the roller shaft 310.

The roller shaft 310 is attached to a support housing 328 of the support and drive assembly 296 by inserting the roller shaft 310 into a bore 330 of the housing 328.

Referring now to FIGS. 9–12, an antenna tower assembly 400 includes an antenna tower 12 having a plurality of vertically-disposed tower legs 20*a*–20*c*, a tower-attaching ring 402 being attached to the antenna tower 12 by brackets 404, an antenna-mounting ring 406 being circumferentially disposed about the tower-attaching ring 402, a support and drive assembly 408 being attached to the antenna-mounting ring 406 by bolts 410, an antenna 412, a support and counterbalance assembly 414 being attached to the antenna-mounting ring 406, a wind vane 416 being attached to the support and counterbalance assembly 414 and support roller assemblies 306 that are attached to the antenna-mounting ring 406 by means which will be subsequently described.

Referring now to FIG. 10, the support and drive assembly 408 includes a housing 418 having an upper housing portion 420 and a lower housing portion 422, a support roller assembly 306 which was previously discussed in conjunction with FIG. 16, and whose shaft, 310, is horizontally disposed in a bore 424 in the upper housing portion 420, an electric drive motor 360 having an output shaft 362, a gear reducer unit 364 being driven by the output shaft 362 of the electric drive motor 360 and having an output shaft 366, a potentiometer 368 that is attached to the gear reducer unit 364 by a shaft 426, and a bevel gear or drive pinion 372 which includes circumferentially-spaced gear teeth 374 and which is attached to the output shaft 366.

The tower-attaching ring 402 includes a circumferential outer surface or circumferential ring surface 428 and a circumferentially disposed V-groove 430 in the circumferential outer surface 428. The groove 430 includes a lower circumferential surface or lower groove surface 432, and an upper circumferential surface or upper groove surface 434. The support roller 308 supportingly engages the support surface 434 of the tower-attaching ring 402.

The tower-attaching ring 402 also includes a plurality of circumferentially-spaced gear teeth 436. The gear teeth 374 of the drive pinion 372 selectively engage the gear teeth 436 as the electric drive motor 360 rotates the output shaft 366 through the gear reducer unit 364.

The antenna 412 is attached to the support and drive assembly 408 by clamping the antenna 412 between the housing portions 420 and 422 of the housing 418.

Figure 9:
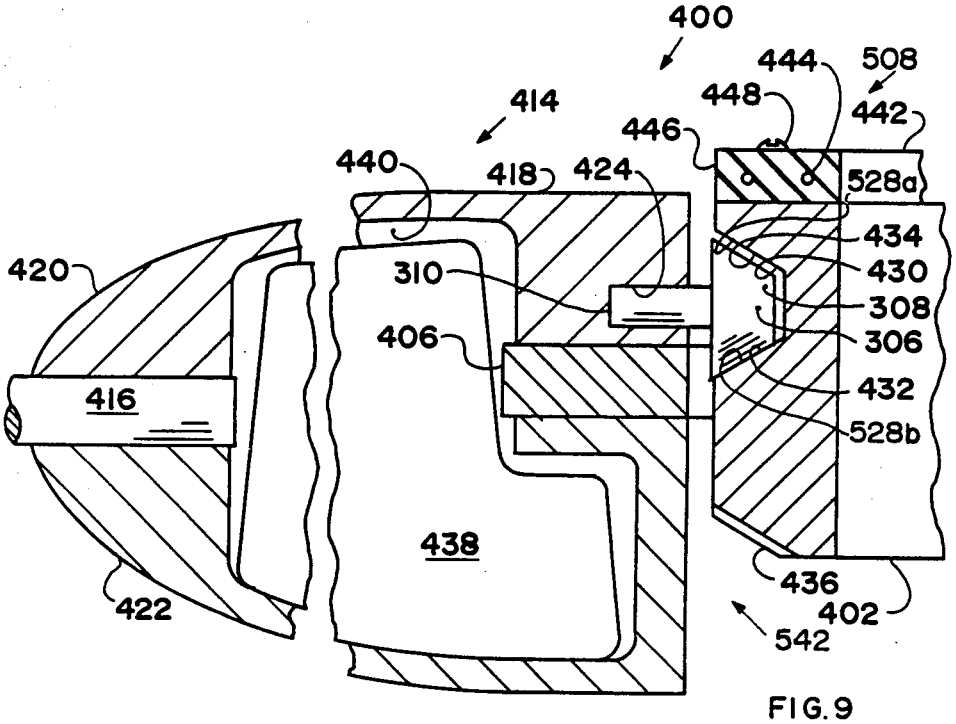
FIG. 9 is a cross-sectional view taken substantially as shown by section line 9—9 of FIG. 11, showing a support roller assembly for the embodiment of FIGS. 9–12 that utilizes two circumferentially-disposed rings.

Referring now to FIG. 9, the support and counterbalance assembly 414 includes a housing 418 having an upper housing portion 420 and a lower housing portion 422, a support roller assembly 306 which is retainingly inserted into a bore 424 of the top housing portion, and a counterbalance weight 438 which has been placed in a cavity 440 of the housing 418. The wind vane 416 is attached to the assembly 414 by clamping the wind vane 416 between the housing portions 420 and 422 of the housing 418.

An electrical resistance heating unit 442 includes an electrical resistance unit 444 that is molded in a dielectric body 446 and that is attached to the tower-attaching ring 402 by screws 448.

Figure 11:
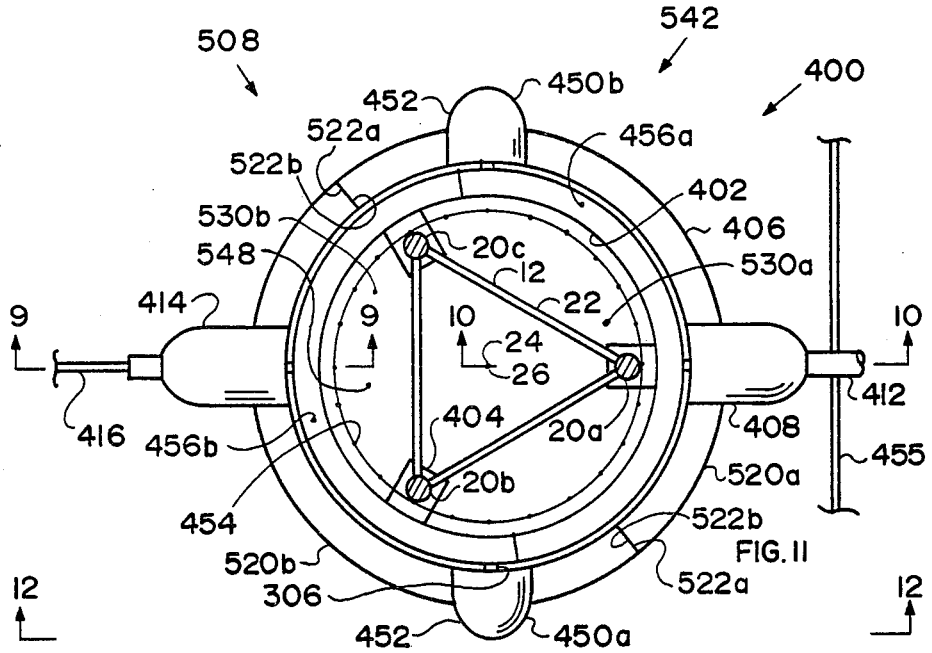
FIG. 11 is a top view of the embodiment that utilizes two circumferentially-disposed rings.
Figure 12:
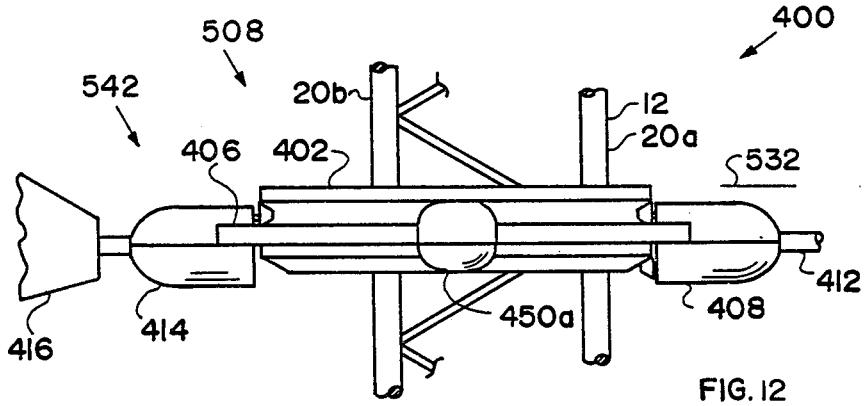
FIG. 12 is a side elevation of the embodiment that utilizes two circumferentially-disposed rings, taken substantially as shown by view line 12—12 of FIG. 11.

Referring now to FIGS. 11 and 12, the tower-attaching ring 402 is attached to the antenna tower 12 by the brackets 404; and the antenna-mounting ring 406 is attached to the tower-attaching ring 402 by four roller and bearing assemblies 306. One roller and bearing assembly 306 is a part of the support and drive assembly 408, a second one of the roller and bearing assemblies 306 is a part of the support and counterbalance assembly 414, and the other two of the roller and bearing assemblies 306 are a part of support roller assemblies **450*a* and 450*b***.

In summary, the embodiment of FIGS. 9–12 includes two rings, 402 and 406, that are coaxially disposed, the tower-attaching ring 402 being attached to the antenna tower 12, and the antenna-mounting ring 406 being supportably and rotatably attached to the tower-attaching ring 402 by the roller and bearing assemblies 306. In the embodiment of FIGS. 9–12, the electric drive motor 260 of FIGS. 9–12 rotates about the antenna tower 12.

Figure 13:
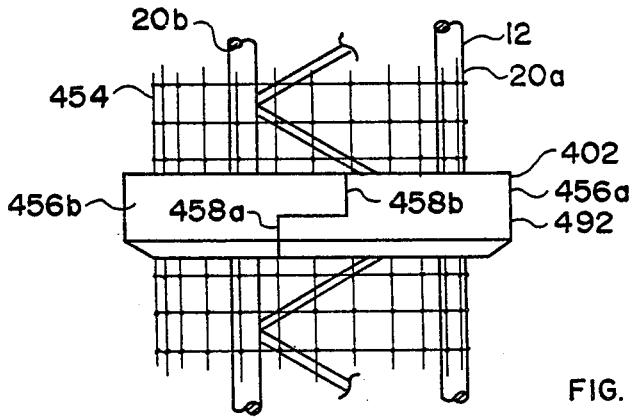
FIG. 13 is a partial side elevation, taken substantially the same as FIG. 12, but showing only the tower-attaching ring and the screen grid that is optional for use as a reflecting device between the tower-attaching ring and the antenna tower.

Referring now to FIGS. 11–13, and more particularly to FIG. 13, optionally, a cylindrically-shaped grid or reflecting device 454, is radially interposed between the antenna tower 12 and the tower-attaching ring 402, and is electrically bonded to the antenna tower 12. The purpose of the reflecting device 454 is to provide a reflecting surface that is uniform in size and is constant in distance from the antenna 412 to the antenna tower 12. As shown in FIG. 11, an element 455 of the antenna 412 remains at a constant distance from the reflecting device as the antenna 412 is rotated. Without the reflecting device 454, both the area of the reflecting surface, and the distance to the reflecting surface from the antenna 412 to the metal of the antenna tower 12 will vary slightly, depending upon the rotational position of the antenna tower 12 with respect to various ones of the tower legs, **20*a*–20*c*, and the strut bracing 22**.

Referring again to FIG. 13, the tower-attaching ring 402 includes arcuate segments **456*a* and 456*b*. The arcuate segments 456*a* and 456*b* are identical and each includes a lapped-joint end 458*a* and 458*b***.

Referring now to FIG. 14, an antenna tower assembly 470 includes an antenna tower 12 having vertically-disposed tower legs **20*a*–20*c*, and a tower-attaching ring 420 that is attached to respective ones of the antenna tower legs 20*a*–20*c* by brackets 404. An antenna-mounting ring 472 is supportingly and rotatably attached to the tower-attaching ring 402 by antenna-attaching and support roller assemblies 474*a* and 474*b*, the support and drive assembly 408 of FIG. 10, two support and counterbalance assemblies 414 of FIG. 9, and a support roller assembly 450*a*. The support roller assembly 450*a* was described in conjunction with FIG. 11**.

The antenna-attaching and support roller assemblies **474*a* and 474*b* each include one of the roller and bearing assemblies 306 and each is constructed substantially the same as the assembly 414 of FIG. 9. Thus it can be seen that the embodiment of FIG. 14 varies from the embodiment of FIGS. 9–12 only in that a Yagi antenna 476 is mounted to both of the assemblies 474*a* and 474*b* rather than being mounted to a single assembly, such as the assembly 408 of FIG. 10. Thus, a total of six assemblies, each having a roller and bearing assembly 306, are used to give greater support for large antennas, such as the Yagi antenna 476. Two support and counterbalance assemblies 414 are used to compensate for the extra size and weight of the Yagi antenna 476 over smaller antenna assemblies; and a wind vane 416 is attached to each of the assemblies 414 to compensate for the large size of the Yagi antenna 476**.

Referring now to FIGS. 15–18, the method of assembly includes placing arcuate segments **456*a* and 456*b* around an antenna tower 12 that has vertrically-disposed tower legs 20*a*–20*c*, connecting an end 482*a* of the segments 456*a* to an end 482*b* of the segments 456*b* to provide a tower-retaining or tower-retained ring 484 having unconnected lapped-joint ends 458*a* and 458*b*, moving the ring 484 up to guy wires 488, lifting the end 458*a* of the ring 484 above the end 458*b* of the ring 484 and above one of the guy wires 488 by rotating the segment 456*a* about a junction or connection 490 between the interconnected ends 482*a* and 482*b*, rotating the end 458*a* around the antenna tower 12, lifting the tower-retaining ring 484 to a desired height position as shown in FIG. 13, connecting the end 458*a* to the end 458*b* to make a complete ring 402 as shown in FIG. 13, and attaching the ring 402 to the antenna tower 12**.

Referring again to FIGS. 15–18, the ends **458*a*, 458*b*, 482*a*, and 482*b*, are of the lapped end construction as shown and each includes two bolt holes 494. Two pieces of woven steel cable 496 and four cable clamps 498 are used to interconnect the ends 482*a* and 482*b* as shown in FIGS. 15 and 19, the cable clamps 498 being positioned on respective ones of the cables 496 to allow the end 458*a* to be lifted above the end 458*b***.

The use of the cables 496 through two of the holes 494 in the ends **482*a* and 482*b* is effective to prevent the ends 458*a* and 458*b* from being spaced-apart far enough for the ring 484 to be separated radially from the antenna tower 12. Therefore, the ring 484 is made to be tower-retaining by interconnecting the ends 482*a* and 482*b***.

In antenna tower assemblies of the type that utilize guy wires to achieve lateral stability of the antenna tower, it is sometimes necessary to disconnect one or more guy wires in order to raise the antenna and/or antenna-mounting parts upwardly past the guy wires.

In the present invention, a tower-attaching ring, an antenna-mounting ring, or any other ring or arcuate segment, may be built or assembled as a tower-retaining ring. Thus, whether the tower-retaining ring is a tower-attaching ring or an antenna-mounting ring, it is assembled to the tower 12, at any convenient height position, by moving a first arcuate segment transversely toward the tower 12 and into an arcuate relationship with the tower 12, by moving a second arcuate segment transversely toward the tower 12 and into tower-encircling relationship with the first arcuate segment, and by interconnecting ends of the arcuate segments.

The tower-retaining ring, whether it be a tower-attaching ring or an antenna-mounting ring, may be raised above the guy wires by rotating one unconnected end above the guy wires. Thus the present invention obviates the danger of men working on a tower with one or more disconnected guy wires or the extra expense of temporarily attaching extra guy wires to provide lateral stability for the antenna tower while the permanent guy wires are disconnected.

The use of a tower-retaining ring also provides greater safety to the tower crew; because a tower-retaining ring, with any other equipment assembled thereto, may be pre-assembled at ground level and may be raised as a unit, being guidingly retained to the tower as the assembly is raised, as opposed to separately carrying many individual parts up the face of the tower and assembling them at the antenna-mounting height.

Referring now to FIGS. 2–7, the method of rotatably mounting an antenna 256 to an antenna tower 12 having three vertically-disposed tower legs, 20*a*–20*c*, comprises attaching one of the support housings 170 to each of two of the tower legs, 20*a* and 20*b*, attaching the support housing 204 to the lower leg 20*c*, placing the antenna-mounting ring 142 around the tower 12, rotatably connecting the ring 142 to the support housing 170 and to the support housing 204 by attaching the support rollers 160 and 219 to the housings 170 and 204, and attaching an antenna 256 to the ring 142.

Referring now to FIGS. 9–12, the method further includes electrically heating the tower-attaching ring or first mounting portion 402 by the use of an electrical resistance heating unit 442, and then rotationally positioning the antenna 412 by use of the electric drive motor 360.

Referring now to FIGS. 2, and 9–12, if respective ones of the antennas, 256, 412, and 476, and if respective ones of the antenna towers 12 are deleted from respective ones of the antenna tower assemblies 140, 400, and 470, the respective antenna tower assemblies become rotationally positionable mounts 504, 508, and 510, respectively.

Referring now to FIG. 2, the antenna-mounting ring 142 includes first and second arcuate segments 512*a* and 512*b*, each having first and second ends 514*a* and 514*b*. The arcuate segments 512*a* and 512*b* are positioned around the antenna tower 12 with the first ends 514*a* abutting the second ends 514*b*. The arcuate segments 512*a* and 512*b* may be interconnected by the attaching lug 258 and the bolts 260, and by the bolts 264 attaching the housing 266 to both of the arcuate segments 512*a* and 512*b*. However, the method and details of connection of the ends 514*a* and 514*b* of the segments 512*a* and 512*b* are not a part of the present invention.

Referring now to FIG. 11, the antenna-mounting ring 406 includes first and second arcuate segments 520*a* and 520*b*, each having first and second ends 522*a* and 522*b*. The arcuate segments 520*a* and 520*b* are positioned around the tower 12 with the first ends 522*a* abutting the second ends 522*b*; and the arcuate segments 520*a* and 520*b* are interconnected by any suitable means.

Referring now to FIGS. 2, 5, and 8–10, the arcuate segments 512*a* and 512*b* each include arcuate surfaces 524*a* and 524*b*, and the arcuate segments 456*a* and 456*b* each include arcuate surfaces 528*a* and 528*b*.

The upper circumferential surfaces 152 and 434 each include one arcuate surface, 524*a* or 528*a*, on each of the respective ones of the arcuate segments, 512*a* and 512*b*, or 456*a* and 456*b*; and lower circumferential surfaces 154 and 432 each include the arcuate surface, 524*b*, or 528*b*, on each of the respective ones of the arcuate segments 512*a* and 512*b*, or 456*a* and 456*b*.

The arcuate segments 512*a*, 512*b*, 520*a*, 520*b*, 456*a*, and 456*b* each include an opening, 530*a* or 530*b*, that is disposed radially inward of an arcuate surface, 152 or 154, or 432 or 434, and that opens outward between the ends 514*a* and 514*b*, 522*a* and 522*b*, or 458*a* and 458*b*, of respective ones of the arcuate segments.

Preferably, all of the segments and rings are disposed about a vertical axis or segment axis 26 that is parallel to the neutral axis 24 of the antenna tower; so all of the segments and rings are disposed in a plane 532 that is orthogonal to the neutral axis 24; and so the circumferential surfaces 152, 154, 432, and 434 are disposed circumferentially around the axis 26. All of the rings 142, 402, and 406 include a tower-receiving or tower-accepting opening 548 that includes the openings 530*a* and 530*b* of the respective arcuate segments.

Referring again to FIG. 11, the antenna tower 12 includes three faces 534*a*–534*c* which comprise a side of the tower 12 that is disposed between any adjacent two of the tower legs 20*a*–20*c*. Thus, in broadest terms, the rotationally positionable mounts 504, 508, and 510 are attached to a face 534*a*–534*c* of the tower 12, as opposed to being attached to a top (not shown) of the tower 12.

In the embodiment of FIGS. 2–7, the first mounting portion includes two of the support housings 170 and the support housing 204; and the antenna-mounting ring 292 is the second mounting portion.

In contrast, in the embodiments of FIGS. 8–13 and FIG. 14, the antenna-attaching ring 402 is the first mounting portion; and the second mounting portion includes the antenna-mounting ring 406 or the antenna-mounting ring 472.

In the embodiment of FIGS. 2–7, the first and second mounting portions are interconnected by attaching a support roller 166 to each of the support housings 170 and by attaching a support roller 219 to the support housing 204.

In the embodiments of FIGS. 8–13 and FIG. 14, the support rollers 306 are frustoconical in shape and include a large diameter end 460 that is adjacent to the roller shaft 310, and a small diameter end 462. In like manner, the drive pinion 372 includes a large diameter end 464 that is adjacent to the shaft 366, and a small diameter end 466.

Referring finally to FIGS. 2–7 and 8–14, if the antennas 256, 412, and 476 and the wind vanes 268 and 416 are deleted from the tower and rotationally positionable mount assemblies 140, 400, and 470, then the assemblies become tower and rotationally positionable mount assemblies 538, 542, and 544.

In summary, the present invention provides means for rotatably mounting one or more search devices to the face of a tower. The search devices which may be mounted include radio antennas, video cameras, and searchlights.

The present invention includes an embodiment wherein a search-device mounting ring is rotatably attached to the three tower legs of the tower by a roller that is operatively attached to each tower leg and that engages a groove in the search-device mounting ring. In this embodiment, the roller shafts are vertically disposed and are both radially and circumferentially disposed about a vertical axis.

This vertical axis is preferably the neutral axis of the tower, but it may be any vertical axis that is disposed radially inside the tower legs and truss bracing of the tower.

The present invention includes a second embodiment wherein two rings are used. One ring is attached to the tower and the other ring is rotatably attached to the first ring by use of a plurality of rollers.

The present invention includes: roller and groove means for supporting, guiding, and stabilizing the search-device mounting ring, counterbalance means for counter-balancing the weight of a search device, torsional wind balance means for counteracting torsional wind loads that are applied to the tower by the search device, electrical means for rotating the search device, means for electrically heating and thus thawing ice from whichever ring includes gear teeth, a reflecting device that prevents an antenna from seeing a varying area of metal in the antenna tower as the antenna is rotated, apparatus and method for assembling the tower-attaching and antenna-mounting rings about the antenna tower at any convenient height, and a method for raising partially-assembled rings above guy wires.

The support rollers cooperate with a first circumferential surface to support a ring-shaped mounting portion, cooperate with a second circumferential surface to vertically restrain the ring-shaped mounting portion and thereby to prevent tilting of the ring-shaped mounting portion, and cooperate with one of the mounting portions to radially guide the ring-shaped mounting portion, as shown in FIGS. 2, 5, 6, and 9–11.

The support rollers each include a roller shaft; and respective ones of the support rollers are supported, vertically restrained, and radially restrained by operative attachment of the respective ones of the roller shafts to another mounting portion, as shown in the drawings.

The present invention provides apparatus and method for mounting a plurality of antennas, or search devices, to a single tower, and for separately rotating, or rotationally positioning, the antennas or search devices. Therefore, the present invention provides functional advantages over prior art systems wherein only one antenna can be rotated, and economic advantages over prior art systems wherein multiple towers are required.

Further, the present invention allows the use of larger antennas on a given size of tower, the use of a larger number of antennas on a given size of tower, or the use of a tower of smaller cross-sectional dimensions and less torsional rigidity for a given number of antennas of a given size; because all of the embodiments of the present invention apply torsional loads equally to all of the tower legs, and because of the torsional wind balance that is provided by the use of wind vanes.

INDUSTRIAL APPLICABILITY

The present invention provides apparatus for the rotatable mounting and both separate and selective rotational positioning of a plurality of antennas or search devices on a single tower.

The present invention may be used by homeowners for mounting and rotating of antennas of the types used for receiving video signals, for broadcasting and receiving of citizens band radio signals, and for receiving both AM and FM radio signals.

The present invention may be used by radio amateurs for both broadcasting and receiving antennas, by commercial radio stations, by microwave transmission companies, and by the military forces for radio communications.

In addition, the present invention may be used to mount and separately rotate such search devices as directional receiving antennas, video cameras, and searchlights in such numbers or combinations as are needed.

What is claimed is:

1. A tower and rotationally positionable mount assembly (538, 542, or 544) which comprises a tower (12) having three vertically-disposed tower legs 20*a*–20*c*), having bracing (22) intermediate of adjacent pairs of said legs that defines a plurality of faces (534*a*–534*c*) of said tower, and having a neutral axis (26) that is disposed intermediate of said faces;

first mounting portion means (170+204, or 402) for operative attachment to one of said faces of said tower;

second mounting portion means (142, 406, or 472), having a tower-receiving opening (548), and having said tower inside said tower-receiving opening, for circumscribing all of said tower legs, for being rotationally positioned around said tower, and for mounting a device thereto;

one (142 or 402) of said mounting portion means comprises first (152 or 432) and second (154 or 434) circumferential surfaces being circumferentially disposed around a second axis (24) that is substantially parallel to said neutral axis, and circumscribing all of said tower legs;

a plurality of roller shafts (182, 188, 218, or 310) being disposed radially outward from said second axis, being spaced circumferentially around said second axis, and being operatively attached to said other (170+204, 406, or 472) mounting portion means;

a plurality of rollers (160, 186, 219, or 308) being operatively attached to said roller shafts, and having roller surface means (162+164, 194+196, or 320) for cooperating with said first circumferential surface;

attaching means, comprising said rollers, and comprising both of said circumferential surfaces, for supportingly attaching said second mounting portion means to said first mounting portion means by operative engagement of said roller surface means with said first circumferential surface, for permitting said second mounting portion means to be rotationally positioned about said second axis, for vertically restraining said second mounting portion means, and for radially guiding said second mounting portion means; and rotational positioning means for rotationally positioning said second mounting portion means with respect to said first mounting portion means.

2. A tower and rotationally positionable mount assembly (542 or 544) as claimed in claim 1 in which said first mounting portion means comprises ring-shaped mounting portion means (402) having a second tower-receiving opening (548), and having said tower disposed inside said second tower-receiving opening, for circumscribing all of said tower legs (20*a*–20*c*).

3. A tower and rotationally positionable mount assembly (542 or 544) as claimed in claim 1 in which said first mounting portion means comprises ring-shaped mounting portion means (402) having a second tower-receiving opening (548), and having said tower disposed inside said second tower-receiving opening, for circumscribing all of said tower legs (20*a*–20*c*); and said one mounting portion means comprises said first mounting portion means, whereby said first (432) and second (434) circumferential surfaces are disposed on said first mounting portion means.

4. A tower and rotationally positionable mount assembly (538) as claimed in claim 1 in which said assembly includes means (246) for resiliently maintaining said roller surface means (162+164, or 192+194) in contact with said first (152) circumferential surface.

5. A tower and rotationally positionable mount assembly (538, 542, or 544) as claimed in claim 1 in which said one mounting portion means (402) includes a circumferential groove (150 or 430) that circumscribes said tower-receiving opening (548) and that includes upper (152 or 434) and lower (154 or 432) groove surfaces; and said circumferential surfaces comprise said groove surfaces.

6. A tower and rotationally positionable mount assembly (538) as claimed in claim 1 in which said one mounting portion means (142) includes a circumferential groove (150) having upper (152 or 434) and lower (154 or 432) groove surfaces;

said groove surfaces comprise said circumferential surfaces; and said assembly includes said (246) for resiliently maintaining said roller surface means (162+164, or 192+194) in contact with said first groove surface.

7. A tower and rotationally positionable mount assembly (538, 542, or 544) as claimed in claim 1 in which said one mounting portion means (142 or 402) includes a ring surface (428) that circumscribes said tower-receiving opening means (548), and a circumferential groove (150 or 430) that extends radially into said one mounting portion means from said ring surface and that includes upper (152 or 434) and lower (154 or 433) groove surfaces;

said upper and lower groove surfaces diverge as said groove surfaces approach said ring surface;

said circumferential surfaces comprise said groove surfaces;

said roller surface means comprises profiled surface means for conforming with said diverging of said groove surfaces; and said attaching means, and said radial guiding thereof, comprises operative engagement of said profiled surface means with one of said groove surfaces.

8. A tower and rotationally positionable mount assembly (538) which comprises a tower (12) having three vertically-disposed tower legs (20*a*–20*c*), having bracing (22) intermediate of adjacent pairs of said legs that defines a plurality of faces (534*a*–534*c*) of said tower, and having a neutral axis (26) that is disposed intermediate of said faces;

first mounting portion means (170+204) for attachment to one of said faces of said tower;

second mounting portion means (142), having a tower-receiving opening (548), and having said tower inside said first tower-receiving opening, for circumscribing all of said tower legs, for being rotationally positioned around said tower, and for mounting a device thereto;

one (142) of said mounting portion means comprises first (152) and second (154) circumferential surfaces being circumferentially disposed around a second axis (24) that is substantially parallel to said neutral axis, and circumscribing all of said tower legs;

a plurality of roller shafts (182, 188, or 218) being spaced radially outward from said second axis, being spaced circumferentially around said second axis, and being operatively attached to said other (170+204) mounting portion means;

a plurality of rollers (160, 186, or 219) being operatively attached to said roller shafts, and providing first (162 or 192) roller surfaces and second (164 or 194) roller surfaces;

attaching means, comprising said rollers, and comprising both of said circumferential surfaces, for supportingly attaching said second mounting portion means to said first mounting portion means by operative engagement of said first roller surfaces with said first circumferential surface, for permitting said second mounting portion means to be rotationally positioned about said second axis, for vertically restraining said second mounting portion means by close proximity of said second circumferential surface to said second roller surfaces, and for radially guiding said second mounting portion means; and rotational positioning means for rotationally positioning said second mounting portion means with respect to said first mounting portion means.

9. A tower and rotationally positionable means assembly (542 or 544) as claimed in claim 8 in which said first mounting portion means comprises ring-shaped mounting portion means (402) having a second tower-receiving opening (548), and having said tower disposed inside said second tower-receiving opening, for circumscribing all of said tower legs (20*a*–20*c*).

10. A tower and rotationally positionable mount assembly (542 or 544) as claimed in claim 8 in which said first mounting portion means comprises ring-shaped mounting portion means (402) having a second tower-receiving opening (548), and having said tower disposed inside said second tower-receiving opening, for circumscribing all of said tower legs (10*a*–20*c*); and said one mounting portion means comprises said first mounting portion means, whereby said first (432) and second (434) circumferential surfaces are disposed on said first mounting portion means.

11. A tower and rotationally positionable mount assembly (538) as claimed in claim 8 in which said assembly includes means (246) for resiliently maintaining said first roller surfaces (162 or 192*d*) in contact with said first circumferential surface (152 or 432), and for maintaining said second roller surfaces (164 or 194) in contact with said second circumferential surface (154 or 434).

12. A tower and rotationally positionable mount assembly (538, 542, or 544) as claimed in claim 8 in which said one mounting portion means (402) includes a circumferential groove (150 or 430) that circumscribes said tower-receiving opening (548) and that includes upper (152 or 434) and lower (154 or 432) groove surfaces; and said circumferential surfaces comprise said groove surfaces.

13. A tower and rotationally positionable mount assembly (538) as claimed in claim 8 in which said one mounting portion means (142) includes a circumferential groove (150) having upper (152) and lower (154) groove surfaces;

said groove surfaces comprise said circumferential surfaces; and said assembly includes means (246) for resiliently maintaining said first roller surfaces (162 or 192) in contact with said first (152) circumferential surfaces, and for resiliently maintaining said second roller surfaces (164 or 194) in contact with said second (154) circumferential surface.

14. A tower and rotationally positionable mount assembly (538, 542, or 544) as claimed in claim 8 in which said one mounting portion means (142 or 402) includes a ring surface (428) that circumscribes said tower-receiving opening means (548), and a circumferential groove (195 or 430) that extends radially into said one mounting portion means from said ring surface and that includes upper (153 or 434) and lower groove surfaces;

one of said groove surfaces diverges from the other of said groove surfaces as said groove surfaces approach said ring surface;

said circumferential surfaces comprise said groove surfaces;

one of said roller surfaces is profiled to conform to said diverging of said one groove surface; and said attaching means, and said radial guiding thereof, comprises operative engagement of said profiled roller surface with said one groove surface.

* * * * *